US006332561B1

(12) United States Patent
Garcia et al.

(10) Patent No.: US 6,332,561 B1
(45) Date of Patent: Dec. 25, 2001

(54) AIRLESS DISPENSING DEVICE

(75) Inventors: Firmin Garcia, Evreux; Hervé Pennaneac'h, Verneuil-sur-Avre; Alain Lafosse, Louversey, all of (FR)

(73) Assignee: Valois S.A., Le Neuboug (FR)

( * ) Notice: Subject to any disclaimer, the term of this patent is extended or adjusted under 35 U.S.C. 154(b) by 0 days.

(21) Appl. No.: 09/647,105

(22) PCT Filed: Mar. 19, 1999

(86) PCT No.: PCT/FR99/00645

§ 371 Date: Jan. 24, 2001

§ 102(e) Date: Jan. 24, 2001

(87) PCT Pub. No.: WO99/48766

PCT Pub. Date: Sep. 30, 1999

(30) Foreign Application Priority Data

Mar. 26, 1998 (FR) ..... 98 03734

(51) Int. Cl.[7] ..... B67D 5/42

(52) U.S. Cl. ..... 222/321.3; 222/321.7; 222/321.9

(58) Field of Search ..... 222/321.1, 321.7, 222/321.9, 321.3

(56) References Cited

U.S. PATENT DOCUMENTS

| | | | | |
|---|---|---|---|---|
| 4,457,455 | | 7/1984 | Meshberg . | |
| 4,458,832 | * | 7/1984 | Corsette | 222/321.7 X |
| 4,496,082 | * | 1/1985 | Corsette | 222/321.7 X |
| 4,524,888 | * | 6/1985 | Tada | 222/321.9 X |
| 4,538,745 | | 9/1985 | Dunning et al. . | |
| 4,696,415 | | 9/1987 | Meshberg . | |
| 5,123,571 | * | 6/1992 | Rebeyrolle et al. | 222/321.7 X |
| 5,335,858 | | 8/1994 | Dunning et al. . | |
| 5,449,094 | * | 9/1995 | Behar et al. | 222/321.9 X |
| 5,549,223 | * | 8/1996 | Hori | 222/321.9 X |
| 5,590,815 | * | 1/1997 | Montaner et al. | 222/321.1 X |

FOREIGN PATENT DOCUMENTS

| | | |
|---|---|---|
| 498 275 | 8/1992 | (EP) . |
| 499 520 | 8/1992 | (EP) . |
| 696 478 | 2/1996 | (EP) . |
| 753 353 | 1/1997 | (EP) . |

* cited by examiner

*Primary Examiner*—Kenneth Bomberg
(74) *Attorney, Agent, or Firm*—Sughrue Mion, PLLC

(57) ABSTRACT

A dispenser device without any air intake, such as an airless pump, for dispensing a fluid substance, the device comprising a dispensing chamber (14) of variable volume, which chamber is provided with an inlet (12) equipped with an inlet valve member (51, 53), and is provided with an outlet equipped with an outlet valve member, the dispenser further comprising a piston (3) for causing the volume of the dispensing chamber (14) to vary, closure elements (51; 52; 55; 63) being provided to close off the dispensing chamber (14) in airtight manner, substantially at its inlet (12), prior to it being used for the first time, the device being characterized in that the closure elements are formed by the inlet valve member (51, 53).

3 Claims, 3 Drawing Sheets

AIRLESS DISPENSING DEVICE

BACKGROUND OF THE INVENTION

The present invention relates to an airless dispenser device such as an airless pump, i.e. a pump without any air intake, so that the substance to be dispensed never comes into contact with air until it is dispensed. Such an airless pump is used, in particular, for dispensing substances that are liable to deteriorate on coming into contact with air. Such substances can be pharmaceuticals or cosmetics.

Conventionally, that type of dispenser comprises a dispensing chamber of variable volume, which chamber is provided with an inlet equipped with an inlet valve, and is provided with an outlet equipped with an outlet valve. In order to vary the volume of the dispensing chamber, a piston is provided that is generally actuated by means of an actuator rod through which the substance is delivered from the chamber. That is a quite conventional design for an airless pump.

In order to avoid any possibility of the substance to be dispensed being deteriorated by coming into contact with air, it is preferable to fill the container under a vacuum, and to mount the dispenser device on the container while it is still under a vacuum. During the operation of mounting the dispenser on the container under vacuum conditions, the inside of the dispenser, and in particular the dispensing chamber, is also subjected to the vacuum. The air is evacuated from the dispensing chamber via the inlet valve whose valve member can be in the form of a ball, of a washer, or of a conical flange member, which valve member does not provide good airtightness during this operation of fixing the dispenser under a vacuum. The valve seat does not have a surface state that is good enough to guarantee good airtightness. Therefore, air is also evacuated from the dispensing chamber and a partial vacuum then prevails therein. It should be noted that, during this step of mounting the dispenser on the container, the dispenser head is not yet mounted on the actuator rod of the dispenser. When the vacuum is interrupted, once the dispenser has been fixed to the container, the container and the pump are once again subjected to atmospheric pressure, so that all of the empty spaces inside the container and also inside the dispensing chamber are suddenly filled with the substance contained in the container. The dispensing chamber is thus at least partially filled. A major drawback then occurs when the dispenser head is mounted on the actuator rod, since mounting the head causes the rod to be displaced, which in turn causes the piston to be displaced, thereby reducing the volume of the dispensing chamber which is at least partially filled with the substance. As a result, substance contained in the dispensing chamber is dispensed. Therefore, prior to the device being sold and being used for the first time, the actuator rod and the expulsion channel in the dispenser head are filled with substance. That substance is then naturally in contact with the outside air, and can thus deteriorate.

Attempts have been made to solve that problem of substance being dispensed while the dispenser head is being mounted. Some such attempts consist in inserting a gas into the chamber before the dispenser is returned to atmospheric pressure. However, such a method is very difficult to implement because of the small diameter of the internal channel in the actuator rod, since it is necessary simultaneously to push back the outlet valve member and to inject the gas into the chamber. Such a gas injection method is therefore very difficult to implement.

Document EP-0 753 353 discloses a dispenser whose inlet tube is formed with a stopper that closes it off. When it is used for the first time, the stopper is punched out by an extension to the actuator rod, which extension penetrates into the inlet tube. The stopper is integrally molded with the inlet tube, which complicates molding. In addition, once it has been punched out, the stopper is free to move inside the inlet tube, and there is therefore a risk that said stopper might hinder dispenser operation.

SUMMARY OF THE INVENTION

An object of the present invention is to mitigate that drawback of the prior art by defining a dispenser whose inlet is initially closed off by a stopper that is easy to put in place, without complicating the molding, and that cannot hinder dispenser operation once it has been dislodged from its closure position.

To this end, the present invention provides a dispenser device without any air intake, such as an airless pump, for dispensing a fluid substance, said device comprising a dispensing chamber of variable volume, which chamber is provided with an inlet equipped with an inlet valve member, and is provided with an outlet equipped with an outlet valve member, said dispenser further comprising a piston for causing the volume of the dispensing chamber to vary, closure means being provided to close off the dispensing chamber in airtight manner, substantially at its inlet, prior to it being used for the first time, the closure means being formed by the inlet valve member.

Since the outlet valve has good airtightness, the inlet closure means make it possible to isolate the dispensing chamber from the outside air with good airtightness. It is thus impossible for an air vacuum to establish itself inside said chamber.

Using the inlet valve member itself as closure means offers the advantage of not adding any additional parts to the dispenser.

In order for the dispensing chamber to be put back into communication with the container, the piston is mounted on an actuator rod having an end that projects into the dispensing chamber, said end forming a pusher member suitable, at the end of its stroke, for pushing the inlet valve member from its airtight position into its normal working position.

In a first practical embodiment, the inlet valve member is a ball wedged in airtight manner in a sleeve.

In a variant, the inlet valve member is a member having a conical flange and provided with a projecting peripheral sealing bead wedged in the inlet of the dispensing chamber.

Thus, the dispensing chamber is well isolated from the outside, and thus it is not subjected to the vacuum that prevails at the time of fixing the dispenser to the container. The closure means are released only on mounting the dispenser head onto the actuator rod, which causes the rod to be displaced inside the chamber until its end displaces the closure means in order to establish communication between the chamber and the container.

By using the inlet valve member to close off the inlet, it is not necessary to mold a stopper, as it is in the prior art, and, once the valve member has been dislodged, there is no danger of it hindering dispenser operation.

BRIEF DESCRIPTION OF THE DRAWINGS

The present invention is described more fully below with reference to the accompanying drawings which give a plurality of embodiments of the present invention by way of example.

In the drawings.

DETAILED DESCRIPTION OF THE PREFERRED EMBODIMENTS

Figure 1A:
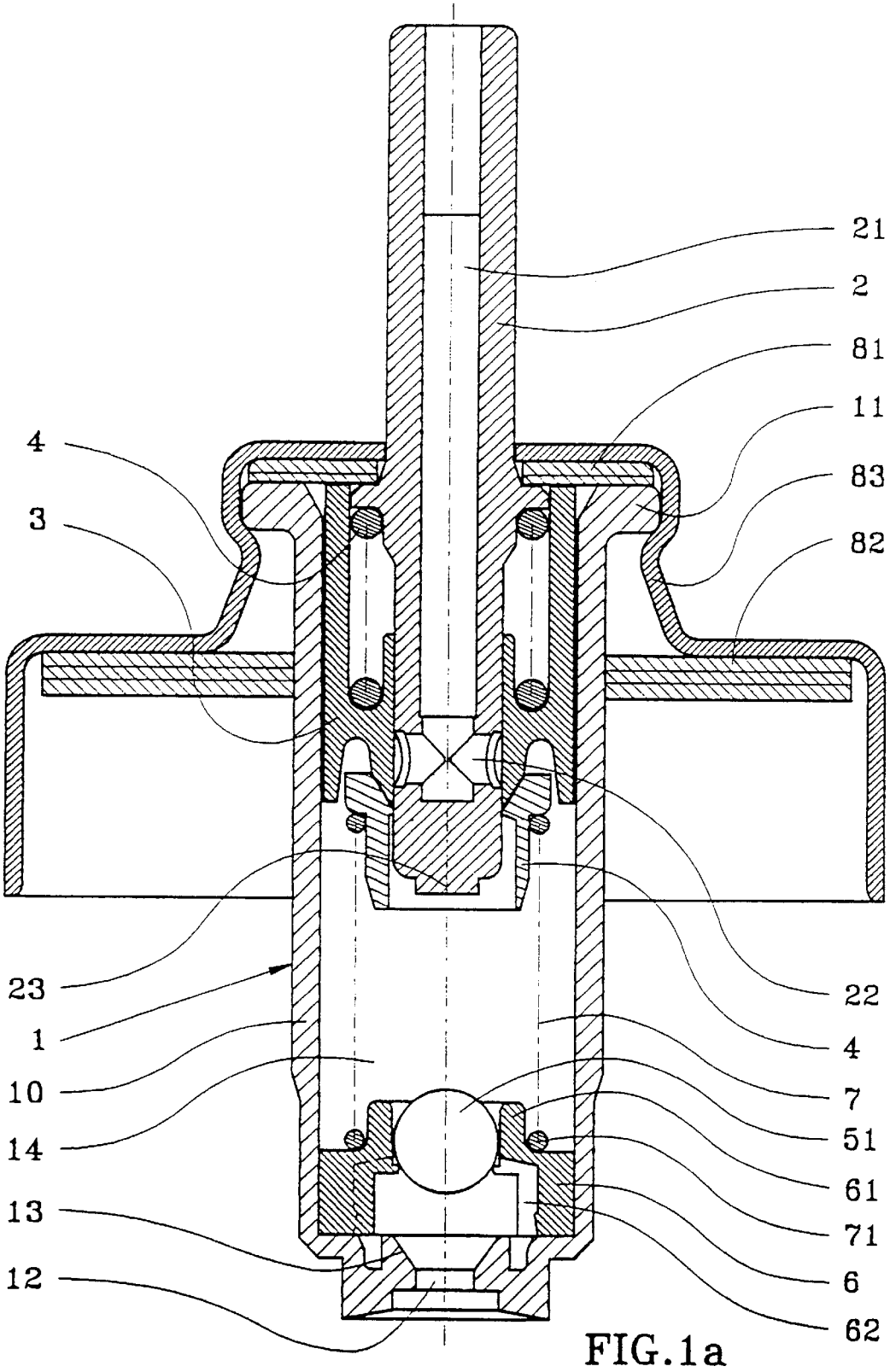
FIG. 1*a* is a longitudinal section view through a first embodiment of a dispenser.
Figure 2A:
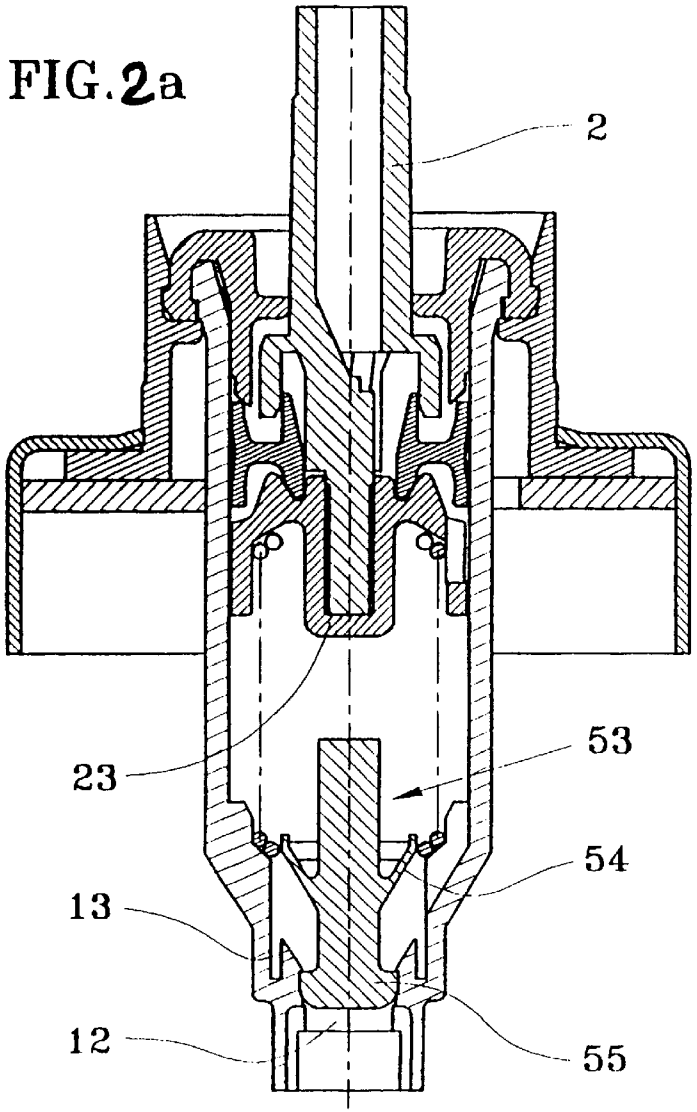
FIGS. 2*a* and 2*b* are longitudinal section views through a second embodiment of a dispenser of the invention.
Figure 2B:
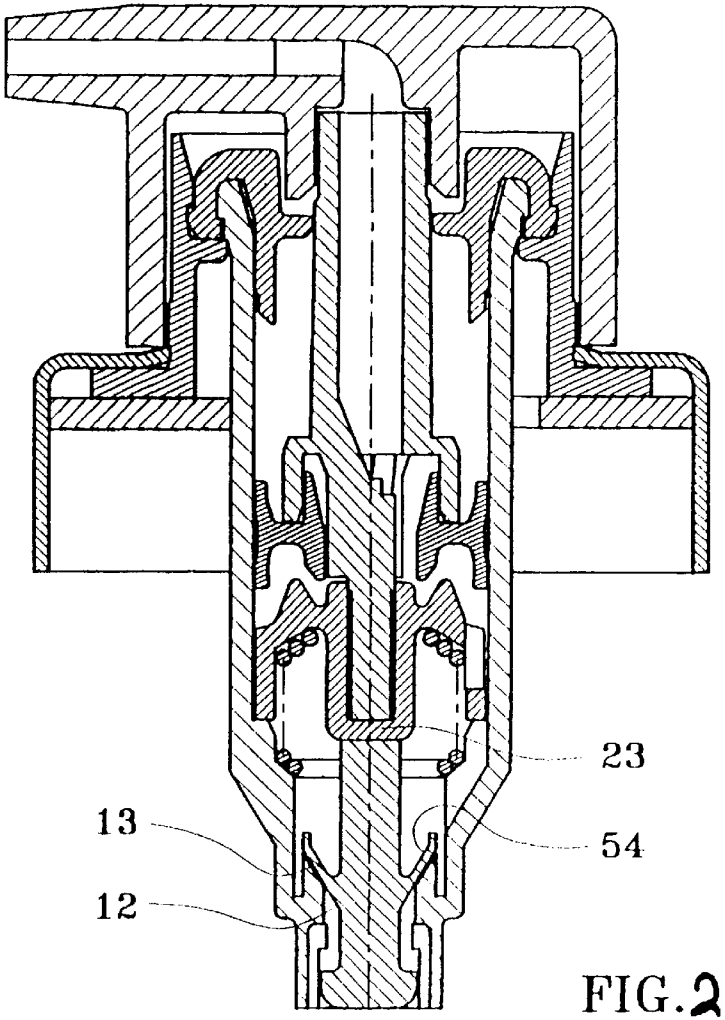

Reference is made below to FIG. 1*a* in order to explain the structure of the dispenser of the invention. In both of the embodiments described, it is an airless pump, i.e. it does not allow any air to be sucked in as the product is being dispensed. It is therefore necessary for the container (not shown) to be capable of reducing its capacity as the product is being extracted from it. It can thus be a container in the form of a flexible pocket or a container equipped with a follower piston. The internal structure of the airless pump is not critical for the invention and is therefore not described in detail herein. However, in the embodiments shown, this airless pump comprises a body 1 defining a cylinder 10 slidably receiving a piston 3 mounted on an actuator rod. The bottom end of the body 1 is provided with an inlet 12 defining a frustoconical valve seat 13. At its top end, the body 1 forms a fixing flange 11 which projects radially outwards. This flange 11 enables the pump to be held by means of a crimpable ring 83. For the purposes of sealing the pump to the container (not shown), two annular gaskets 81 and 82 are placed respectively between the flange 11 and the crimpable ring 83, and between the top end of the container (not shown), and the crimpable ring 83. The pump is thus fixed to the neck of the container (not shown) in fully airtight manner. As mentioned above, the cylinder 10 that forms the body 1 receives a piston 3 which is itself slidably mounted on the actuator rod 2. The piston 3 is urged into its rest high position shown in FIG. 1*a* by a return spring 7 which acts via a plunger 4 that bears against the piston 3. In addition, the actuator rod 2 is urged into its rest position shown in FIG. 1*a* by a spring 4 that bears against the piston 3. In conventional manner, the actuator rod 2 defines an outlet duct 21 which defines two side openings 22 in the vicinity of its bottom end, which openings are closed off by the piston when it is in the rest position (FIG. 1*a*). The arrangement formed by the bottom end of the actuator rod 2, by the piston 3, and by the plunger 4 constitutes the outlet valve member of the airless pump. Below this arrangement, the pump body 1 forms a pump chamber 14 of variable volume. At its bottom end, the pump chamber is provided in conventional manner with an inlet valve member 51 which, in FIG. 1*a*, is in the form of a spherical ball. Other forms of inlet valve member may be considered, such as, for example, a member with a conical flange (FIGS. 2*a* and 2*b*).

The design of the above-described airless pump is quite conventional and is common to both of the embodiments. Naturally, other designs may be considered for the structure of the pump without going beyond the ambit of the present invention.

As can be seen in FIG. 1*a*, the ball 51 does not rest on its valve seat 13, but rather it is engaged in a sleeve 61 in which it is wedged. The sleeve is formed by a substantially cylindrical part 6 engaged inside the body 10, and resting against the bottom of the body by being pressed thereagainst by the spring 7 which bears via its bottom end 71 against said part. As a result, the cylindrical part 6 is held firmly inside the body 10. The cylindrical part 6 further defines side drains 62 through which the substance can pass. In the position shown in FIG. 1*a*, the inlet valve member 51 does not rest on its seat 13 so that it cannot perform its function of selectively closing the inlet 12 of the pump chamber 14. The pump chamber 14 is fully isolated from the outside in airtight manner. As described above, the ball 51 wedged in the sleeve 61 prevents any air from passing through via the inlet of the pump chamber, and the piston 3 being positioned over the side openings 22 in the actuator rod 2 prevents any air from passing through via the outlet valve of the pump chamber 14. Therefore the pump chamber 14 defines an isolated space.

As described above in the introduction, during the operation of mounting the pump under a vacuum onto the neck of a full container, the entire pump and the entire container are disposed in an enclosure from which the air has been evacuated to form an air vacuum. By isolating the pump chamber 14 from the outside in fully airtight manner, said chamber is not subjected to an air vacuum during the mounting operation performed under a vacuum. When the outside pressure decreases, as it does when an air vacuum is formed, the outlet valve remains fully closed in airtight manner and the ball 51 wedged firmly in the sleeve 61 also guarantees full airtightness, so that, when the air vacuum is interrupted, and the dispenser as a whole and as equipped with the container filled with the substance is once again at normal atmospheric pressure, the substance contained in the container cannot rise into the pump chamber 14 because its inlet is closed off by the presence of the ball 51 wedged in the sleeve 61. This thus ensures that the pump chamber 14 remains filled with air at atmospheric pressure, and that no substance finds its way into the chamber 14.

Figure 1C:
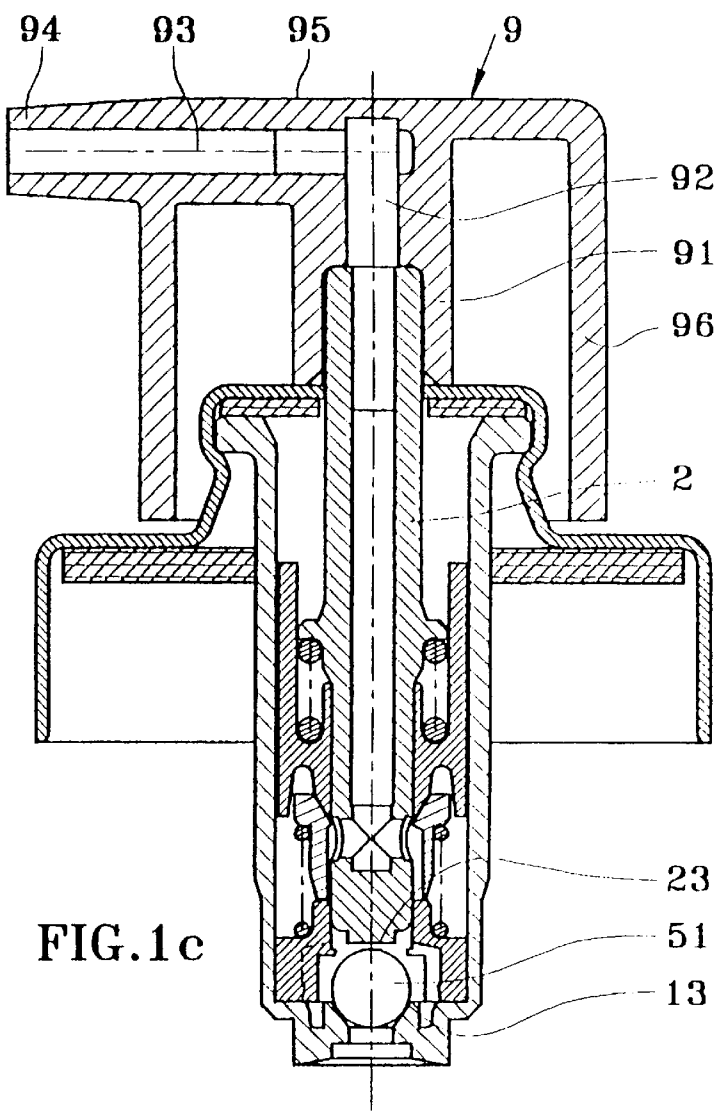
FIGS. 1*b* and 1*c* are longitudinal section views through the dispenser of FIG. 1*a* during the step of mounting the dispenser head, so as to show how the closure means are released.
Figure 1B:
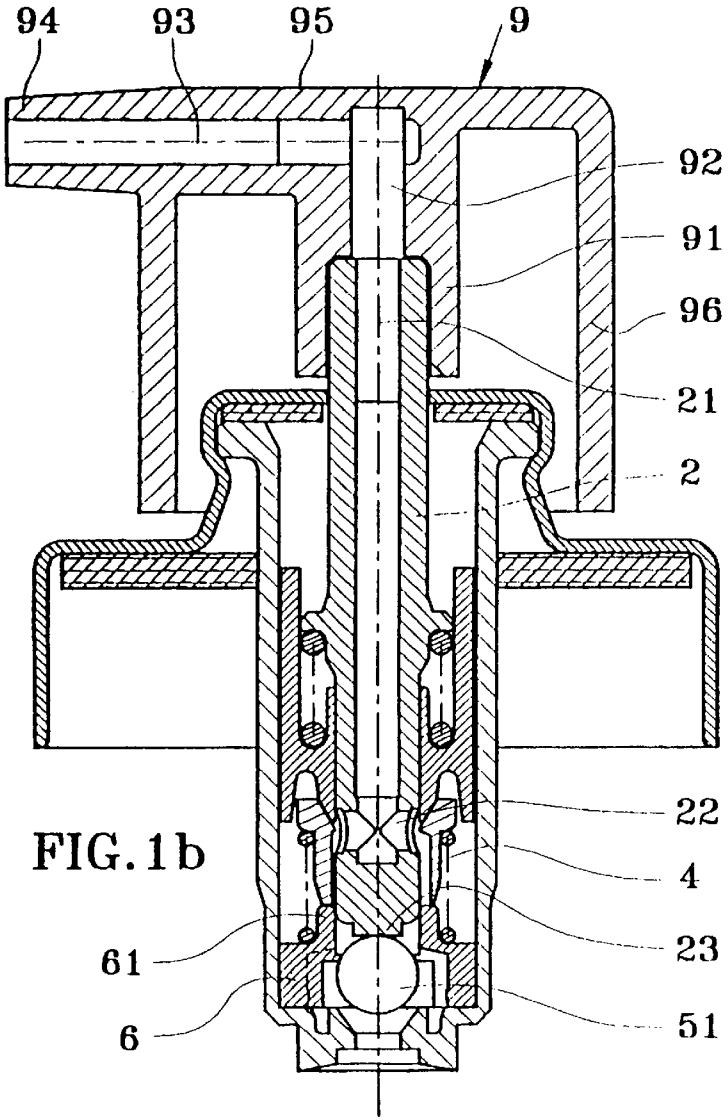

Thus, after the vacuum filling operation, the airless pump is as shown in FIG. 1*a*. In this state, the pump is unusable because the ball 51 closes off the inlet of the pump chamber 14. In order to bring the pump into an operational state, it is necessary for the ball 51 to take up its normal working position against the conical inlet valve seat 13. To achieve this, it is necessary merely to push the ball 51 downwards to release it from being wedged in the sleeve 61. With reference to FIGS. 1*b* and 1*c*, a description follows of how it is possible to release the ball 51 from its airtight wedging in the sleeve 61. Once the mounting operation of crimping the pump to the container under a vacuum has been performed, the next conventional step is to mount the dispenser head 9 onto the actuator rod 2. A conventional dispenser head comprises a connection sleeve 91 defining an internal channel 92 which is extended sideways by an outlet duct 93 terminating in a dispenser nozzle 94. Outwardly, the dispenser head 9 may form a peripheral skirt 96 that extends downwards to mask a portion of the pump and of the actuator rod 2. To fit the dispenser head 9 onto the actuator rod 2, it is necessary to position the sleeve 91 in alignment with the rod 2, and then to exert thrust against the surface 95 of the head 9 in order to achieve the interfitting shown in FIGS. 1*b* and 1*c*. When the thrust is exerted against the surface 95, the actuator rod 2 is urged downwards inside the body of the pump, while entraining the piston 3 with it. By penetrating further into the body 1 in this way, the actuator rod reduces the volume of the pump chamber 14 against the action of the return spring 7. As the actuator rod 2 penetrates further into the body, the piston 3 and the plunger 4 move over the rod in the opposite direction so as to uncover the side openings 22, thereby establishing passageways through which air can pass between the pump 14 and the outside via the channel 21, the duct 92 and the duct 93. In other words, the outlet valve opens when the pressure inside the pump chamber 14 is high enough to push the piston 3 back and uncover the side openings 22. If the pushing on the actuator rod 2 is continued, said rod continues its stroke inside the pump body until its bottom end 23 comes into pushing contact against the ball 51 wedged in the sleeve 61. By exerting sufficient pressure, it is possible to cause the end 23 of the rod 2 to dislodge the ball 51 from its sleeve 61, as shown in FIG. 1*b*. By continuing to push on the actuator rod 2 until the sleeve 91 of the head 9 comes into abutment against the crimpable ring 83, it is possible to cause the bottom end 23 of the rod 2 serving as a pusher member to release the ball 51 completely from the sleeve 61, so that the ball can come into position against the conical inlet valve seat 13, which position constitutes its normal working position, enabling the inlet 12 of the pump chamber 14 to be selectively closed off.

To sum up, the inlet valve member, constituted by a ball 51 in this example and that acts as closure means to isolate the chamber 14 during the crimping operation performed under a vacuum, is then pushed into its normal working position by means of the bottom end of the actuator rod 2 serving as a pusher member on mounting the dispenser head 9 onto said actuator rod 2. Therefore, it is possible to release the ball 51 form its sleeve 61 without using any additional parts and without performing any additional operations, because mounting the actuator head 9 onto the rod 2 is an operation that is conventional and necessary.

A secondary advantage further results from using the cylindrical part 6 to form the sleeve 61 serving to wedge the ball 51. The cylindrical part 6 can co-operate with the valve seat 13 to define a space constituting a housing in which the ball 51 is held captive, so that its freedom of movement is limited. This thus ensures that the ball 51 always comes accurately into position against its valve seat 13.

Compared with a conventional airless pump known from the prior art, the only difference lies in the use of the cylindrical part 6 to wedge the ball. It is very simple to mold and to put in place, without any extra cost or any major technical investment. When mounting the pump, the ball 51 is pre-engaged by force in the sleeve 61 formed by the cylindrical part 6, and then the resulting assembly is merely inserted into the body of the pump 1. It can thus be understood that it is very simple to release the closure means without using either any additional parts or any additional operations.

FIGS. 2*a* and 2*b* show a variant of the inlet valve in the form of a member 53 provided with a conical flange 54 serving to co-operate with the conical surface 13 of the valve seat. The closure function performed by the closure ball 52 is then performed by a projecting peripheral sealing bead 55 suitable for being positioned in the inlet 12 in the same way as the ball 52. When mounting the dispenser head 9 shown in FIG. 2*b*, the member 53 is then merely pushed by the pusher stud 23 that forms the bottom end of the actuator rod 2, so that the bead is released from the inlet 12 and so that the conical flange can then come into airtight abutment against the conical surface of the inlet valve 13. The use of such a valve member instead of the balls 51 and 52 offers several advantages. Firstly, it constitutes a one-piece part rather than two separate parts, so that the means serving to close off the inlet remain connected to the means serving as valve member, whereas when a closure ball 52 is used, it is expelled into the container. Secondly, such a member can be made of molded plastics, which is firstly less costly and secondly advantageous in terms of recycling capacity.

By means of the invention, it is possible to isolate the dispensing chamber 14 in fully airtight manner during a fixing operation, in particular a crimping operation, performed under a vacuum, and to do so very simply. Furthermore, the closure means can be released very simply without any additional operation or any additional member being required.

What is claimed is:

1. A dispenser device without any air intake for dispensing a fluid substance, said device comprising a dispensing chamber (14) of variable volume, which chamber is provided with an inlet (12) equipped with an inlet valve member (51, 53), and is provided with an outlet equipped with an outlet valve member, said dispenser further comprising a piston (3) for causing the volume of the dispensing chamber (14) to vary, closure means (51; 52; 55; 63) being provided to close off the dispensing chamber (14) in airtight manner, substantially at its inlet (12) prior to it being used for the first time, said device being characterized in that the closure means are formed by the inlet valve member (51, 53), wherein the piston (3) is mounted on an actuator rod (2) having an end (23, 24) that projects into the dispensing chamber, said end forming a pusher member (23) suitable, at the end of its stroke, for pushing the inlet valve member (51; 53) from its airtight position into its normal working position.

2. A dispenser device without any air intake for dispensing a fluid substance, said device comprising a dispensing chamber (14) of variable volume, which chamber is provided with an inlet (12) equipped with an inlet valve member (51, 53), and is provided with an outlet equipped with an outlet valve member, said dispenser further comprising a piston (3) for causing the volume of the dispensing chamber (14) to vary, closure means (51; 52; 55; 63) being provided to close off the dispensing chamber (14) in airtight manner, substantially at its inlet (12), prior to it being used for the first time, said device being characterized in that the closure means are formed by the inlet valve member (51, 53), wherein the inlet valve member is a ball (51) wedged in airtight manner in a sleeve (61).

3. A dispenser device without any air intake for dispensing a fluid substance, said device comprising a dispensing chamber (14) of variable volume, which chamber is provided with an inlet (12) equipped with an inlet valve member (51, 53), and is provided with an outlet equipped with an outlet valve member, said dispenser further comprising a piston (3) for causing the volume of the dispensing chamber (14) to vary, closure means (51; 52; 55; 63) being provided to close off the dispensing chamber (14) in airtight manner, substantially at its inlet (12), prior to it being used for the first time, said device being characterized in that the closure means are formed by the inlet valve member (51, 53), wherein the inlet valve member is a member (53) having a conical flange (54) and provided with a projecting peripheral sealing bead (55) wedged in the inlet (12) of the dispensing chamber (14).

* * * * *